US008971740B2

(12) United States Patent
Harashima et al.

(10) Patent No.: US 8,971,740 B2
(45) Date of Patent: Mar. 3, 2015

(54) IMAGE FORMING APPARATUS

(71) Applicant: Konica Minolta, Inc., Tokyo (JP)

(72) Inventors: Takashi Harashima, Sagamihara (JP); Katsuyuki Hirata, Toyokawa (JP)

(73) Assignee: Konica Minolta, Inc. (JP)

( * ) Notice: Subject to any disclaimer, the term of this patent is extended or adjusted under 35 U.S.C. 154(b) by 0 days.

(21) Appl. No.: 14/068,888

(22) Filed: Oct. 31, 2013

(65) Prior Publication Data

US 2014/0133875 A1 May 15, 2014

(30) Foreign Application Priority Data

Oct. 31, 2012 (JP) ..... 2012-240061

(51) Int. Cl.
*G03G 15/00* (2006.01)
*G03G 15/20* (2006.01)

(52) U.S. Cl.
CPC ..... *G03G 15/205* (2013.01); *G03G 15/5062* (2013.01); *G03G 2215/2074* (2013.01)
USPC ..... 399/49; 399/68; 399/72

(58) Field of Classification Search
USPC ..... 399/15, 33, 49, 68, 72, 322
See application file for complete search history.

(56) References Cited

U.S. PATENT DOCUMENTS 6,961,526 B2 * 11/2005 Tezuka et al. ..... 399/15
7,590,363 B2 * 9/2009 Yokoyama ..... 399/49 X
7,890,009 B2 * 2/2011 Ito et al. ..... 399/68 X
8,036,545 B2 * 10/2011 Kanno ..... 399/33
8,059,318 B2 * 11/2011 Maebashi et al. ..... 399/15 X
8,144,365 B2 * 3/2012 Kita et al. ..... 399/49 X
2006/0018674 A1 1/2006 Hirata et al.
2010/0239300 A1 9/2010 Sato
2011/0194860 A1 * 8/2011 Peng et al. ..... 399/15
2011/0217052 A1 9/2011 Usui et al.

FOREIGN PATENT DOCUMENTS

JP 2004-029302 A 1/2004
JP 2006-039036 A 2/2006
JP 2008-122513 A 5/2008
JP 2010-217565 A 9/2010
JP 2011-118287 A 6/2011
JP 2011-186087 A 9/2011

* cited by examiner

*Primary Examiner* — Sandra Brase
(74) *Attorney, Agent, or Firm* — Cantor Colburn LLP

(57) ABSTRACT

An image forming apparatus has a detector that includes a toner density sensor arranged on the downstream side of a fixing section. When performing a control to determine an image forming condition of an image forming section based on the detection result of an image-adjusting pattern image obtained by the detector, the temperatures of a plurality of points in the axial direction of the fixing section are detected by a fixing temperature detector. Further, based on the temperature detection values obtained by the fixing temperature detector, a controller sets a detection area of the detector in a place where the fixing temperature is equal to a desired temperature, so that the detector detects the information about the image-adjusting pattern image at such place.

15 Claims, 15 Drawing Sheets

IMAGE FORMING APPARATUS

CROSS REFERENCES TO RELATED APPLICATIONS

The present invention contains subject matter related to Japanese Patent Application JP 2012-240061 filed in the Japanese Patent Office on Oct. 31, 2012, the entire contents of which being incorporated herein by reference.

BACKGROUND OF THE INVENTION

1. Field of the Invention

The present invention relates to an image forming apparatus and an image forming method, particularly to an electrophotographic image forming apparatus and an electrophotographic image forming method.

2. Description of the Related Art

In an electrophotographic image forming apparatus, since the image is formed using static electricity, the image density, line width, and the print position will fluctuate due to fluctuation in environmental conditions (such as temperature and humidity of the environment where the image forming apparatus is used), time degradation of a photoreceptor, a developer and/or the like (i.e., change in durability), and therefore it is not possible to perform stable image formation.

In order to prevent such problem, a control for stabilizing the image to be formed is performed (such control is referred to as "image stabilization control" hereinafter) is performed in which information about environmental conditions, information about durability, and information about an image-adjusting pattern image are detected and fed back to the condition for forming image (referred to as "image forming condition" hereinafter) to thereby stabilize the image to be formed (see, for example, Japanese Unexamined Patent Application Publication No. 2006-39036). Here, the "image-adjusting pattern image" is a pattern image exclusively formed for adjusting image. By performing the image stabilization control, it is possible to stably form an image even if there are factors that destabilize the image formation.

Generally, it is known there are two image stabilization control methods, one is a method in which the toner density of an unfixed image-adjusting pattern image formed on an intermediate transfer belt is detected by a toner density sensor arranged opposing the intermediate transfer belt (such method is referred to as an "image stabilization control method (1)" hereinafter), and the other one is a method in which the toner density of an image-adjusting pattern image fixed onto the sheet is detected by a toner density sensor arranged in a sheet conveying section provided on the downstream side of the fixing section (such method is referred to as "image stabilization control method (2)" hereinafter).

In the image stabilization control method (1), since the toner density sensor is located on the downstream side of a secondary transfer section and arranged so as to face the intermediate transfer belt, it is not possible for the toner density sensor to detect fluctuation generated in both the secondary transfer section and the fixing section, and feed back the fluctuation to the image forming condition. In contrast, in the image stabilization control method (2), since it is also possible to detect the fluctuation generated in both the secondary transfer section and the fixing section, which can not be detected by the image stabilization control method (1), and feed back the fluctuation to the image forming condition, high image quality can be obtained compared with the image stabilization control method (1).

However, in the image stabilization control method (2), when using the toner density sensor to detect the information about the color, the density and the like of the image fixed onto the sheet, if such information is detected immediately after the sheet has passed through the fixing section, there is a possibility that, due to the influence of a phenomenon called "thermochromism", the color may change compared with the image quality seen by the user. Here, "thermochromism" means a phenomenon in which the color of the toner changes due to heat. A technique for compensating the influence of thermochromism has been proposed (see, for example, Japanese Unexamined Patent Application Publication No. 2011-186087).

SUMMARY OF THE INVENTION

However, due to various factors, there is a possibility that temperature unevenness may be caused in the axial direction of fixing rollers of the fixing section (i.e., the direction perpendicular to the conveying direction of the sheet). If temperature unevenness is caused in the axial direction of the fixing rollers of the fixing section, there will be influence of the phenomenon of thermochromism caused by the temperature unevenness.

In other words, due to the influence of the phenomenon of thermochromism caused by temperature unevenness in the axial direction of the fixing section, the color detection performed by the toner density sensor may become incorrect, so that there is a possibility that the color of the output image (the print image) may become inappropriate even if a control by the image stabilization control method (2) is performed, and therefore the image quality deteriorates.

An object of the present invention is to provide an image forming apparatus capable of correctly detecting information about a fixed image even if there is temperature unevenness in the axial direction of the fixing rollers of the fixing section, and determining the image forming condition based on the detection result.

To achieve the aforesaid object, an image forming apparatus according to an aspect of the present invention is the one that uses an image-adjusting pattern image to determine an image forming condition, which includes: a detector adapted to detect information about an image-adjusting pattern image fixed onto a sheet; a fixing temperature detector having a plurality of sensors adapted to detect temperatures of a plurality of points in the axial direction of a fixing roller of a fixing section, wherein the fixing section is adapted to fix the image-adjusting pattern image onto the sheet; and a controller adapted to set, based on temperature detection values detected by the fixing temperature detector, a detection area in a place of the detector where the temperature is equal to a desired temperature, wherein the detection area is an area where the detector detects information about the image-adjusting pattern image, and use the information detected in the detection area by the detector to determine the image forming condition.

An image forming method according to another aspect of the present invention is the one that uses an image-adjusting pattern image to determine an image forming condition, which includes the steps of: detecting, by a fixing temperature detector having a plurality of sensors, temperatures of a plurality of points in the axial direction of a fixing roller of a fixing section, wherein the fixing section is adapted to fix the image-adjusting pattern image onto a sheet; and setting, based on temperature detection values detected by the fixing temperature detector, a detection area in a place of a detector where the temperature is equal to a desired temperature, wherein the detection area is an area where the detector detects information about the image-adjusting pattern image, and using the information detected in the detection area by the detector to determine the image forming condition.

In the image forming apparatus having the aforesaid configuration, when performing a control to determine the image forming condition based on the detection result of the information about the image-adjusting pattern image obtained by the detector, the temperatures of a plurality of points in the axial direction of the fixing roller of the fixing section are detected by the fixing temperature detector. Further, under the control of the controller, based on the temperature detection values of the plurality of points, the detection area of the detector is set at a place where the fixing temperature is equal to the desired temperature. Thus, the image forming condition is determined based on the detection result of the information about the image-adjusting pattern image in an area not affected by the phenomenon of thermochromism caused by the temperature unevenness in the axial direction of the fixing section.

DETAILED DESCRIPTION OF THE PREFERRED EMBODIMENT

An embodiment for carrying out the present invention will be described below with reference to the attached drawings. Note that, in the following description and attached drawings, the same components or the components having the same function are denoted by the same numerals, and the explanation thereof will not be repeated.

[Configuration Example of Image Forming Apparatus]

Figure 1:
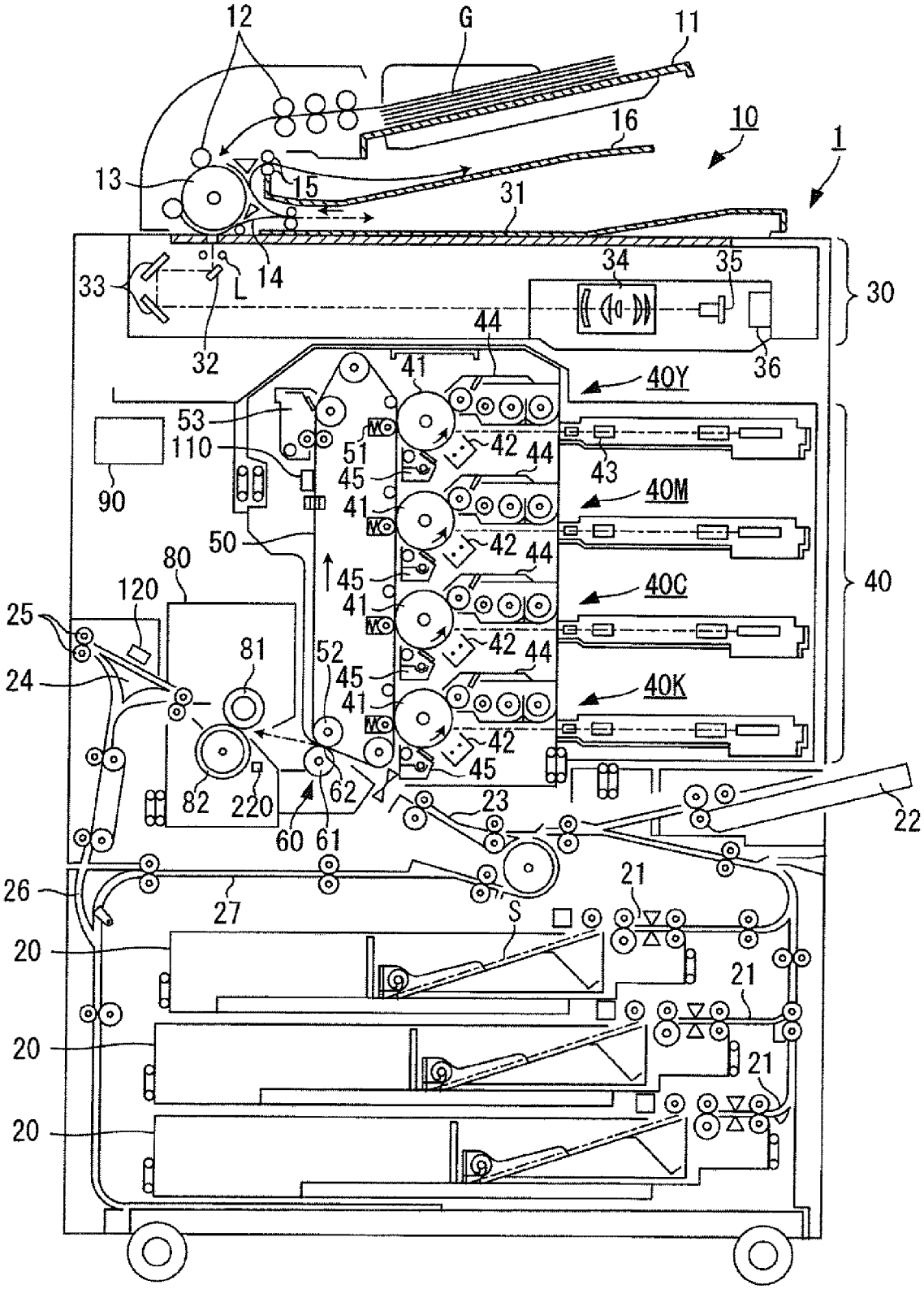
FIG. 1 is a schematic view showing the overall configuration of the system configuration of an image forming apparatus according to an embodiment of the present invention.

FIG. 1 is a schematic view showing the overall configuration of the system configuration of an image forming apparatus 1 according to an embodiment of the present invention. The present embodiment is described based on an example in which the present invention is applied to a copying machine.

As shown in FIG. 1, the image forming apparatus 1 is an electrophotographic image forming apparatus that forms an image using static electricity. The image forming apparatus 1 is a tandem type color image forming apparatus, in which four colors of toner, which are yellow (Y), magenta (M), cyan (C), and black (K), are superimposed one on top of another. The image forming apparatus 1 includes a document conveying section 10, a plurality of sheet accommodating sections 20, an image reading section 30, an image forming section 40, an intermediate transfer belt 50, a secondary transfer section 60, a fixing section 80, and a control board 90.

The document conveying section 10 includes a document feeding table 11 for setting a document G, a plurality of rollers 12, a conveying drum 13, a conveying guide 14, a document ejecting roller 15, and a document receiving tray 16. The document G set on the document feeding table 11 is conveyed page by page to a reading position of the image reading section 30 by the plurality of rollers 12 and the conveying drum 13. The conveying guide 14 and the document ejecting roller 15 eject the document G conveyed by the plurality of rollers 12 and the conveying drum 13 to the document receiving tray 16.

The image reading section 30 reads the image of the document G conveyed by the document conveying section 10 or the image of a document placed on a platen 31, and creates image data. To be specific, the image of the document G is irradiated by a lamp L. The light reflected from the document G based on the light radiated from the lamp L is guided to a first mirror unit 32, a second mirror unit 33 and a lens unit 34 in that order, so as to form an image on a light receiving surface of an image pickup device 35. The image pickup device 35 photoelectrically converts the light incident thereon and outputs a prescribed image signal. The image signal outputted by the image pickup device 35 is A/D converted to thereby create image data.

The image reading section 30 has an image reading control section 36. The image reading control section 36 performs various well-known image processing, such as shading correction, dither processing, compression and/or the like, on the image data created by the A/D conversion, and stores the resultant data in a RAM (not shown) mounted on the control board 90. Incidentally, the image data is not limited to the data outputted from the image reading section 30, but may be data received from an external device (such as a personal computer, another image forming apparatus or the like) connected to the image forming apparatus 1.

The plurality of sheet accommodating sections 20 are arranged in the lower portion of the main body of the apparatus, and the number of the sheet accommodating sections 20 is determined according to the sizes and/or kinds of sheets S. The sheet S is fed by a sheet feeding section 21 and conveyed to a conveying section 23, and is then conveyed to the secondary transfer section 60 (which is the transfer position) by the conveying section 23. Further, a manual sheet feeding section 22 is arranged in the vicinity of the sheet accommodating sections 20. A specialty sheet, such as a sheet of a size not accommodated in the sheet accommodation section 20, a tag sheet having a tag, an OHP sheet or the like, is set to the manual sheet feeding section 22 by the user and sent to the transfer position from the manual sheet feeding section 22.

The image forming section 40 and the intermediate transfer belt 50 are arranged between the image reading section 30 and the sheet accommodating section 20. The image forming section 40 has four image forming units 40Y, 40M, 40C, 40K for forming a toner image of yellow (Y), a toner image of magenta (M), a toner image of cyan (C), and a toner image of black (K).

To be specific, the first image forming unit 40Y forms a toner image of yellow, the second image forming unit 40M forms a toner image of magenta, the third image forming unit 40C forms a toner image of cyan, and the fourth image forming unit 40K forms a toner image of black. Since the four image forming units 40Y, 40M, 40C, 40K have the same configuration, only the first image forming unit 40Y will be described herein.

The first image forming unit 40Y has a drum-like photoreceptor 41, a charging section 42 arranged around the photoreceptor 41, an exposure section 43, a developing section 44, and a cleaning section 45. The photoreceptor 41 is driven to rotate by a drive motor (not shown). The charging section 42 applies electric charges to the photoreceptor 41 so that the surface of the photoreceptor 41 is evenly charged. The exposure section 43 performs exposure on the surface of the photoreceptor 41 based on the image data read from the document G or the image data transmitted from the external device, to thereby form an electrostatic latent image on the photoreceptor 41.

The developing section 44 develops the electrostatic latent image formed on the photoreceptor 41 using a two-component developer consisting of toners and carriers, wherein the toners are particles for forming an image, and the carriers have a function of providing appropriate electric charge to the toners by frictional charging caused by mixing the carriers with the toners within the developing section 44, a function of conveying the toners to a development area facing the photoreceptor 41, and a function of forming a development field so that the toners can faithfully develop the electrostatic latent image on the photoreceptor 41. The developing section 44 causes yellow toner to adhere to the electrostatic latent image formed on the photoreceptor 41. Thus, a toner image of yellow is formed on the surface of the photoreceptor 41.

Incidentally, the developing section 44 of the second image forming unit 40M causes the magenta toner to adhere to the photoreceptor 41 of the second image forming unit 40M, the developing section 44 of the third image forming unit 40C causes the cyan toner to adhere to the photoreceptor 41 of the third image forming unit 40C, and the developing section 44 of the fourth image forming unit 40K causes the black toner to adhere to the photoreceptor 41 of the fourth image forming unit 40K.

The cleaning section 45 removes the toner remaining on the surface of the photoreceptor 41.

The toner adhering to the photoreceptor 41 is transferred to the intermediate transfer belt 50 (which is an example of the intermediate transfer body). The intermediate transfer belt 50 is an endless belt wrapped around a plurality of rollers. The intermediate transfer belt 50 is driven by a drive motor (not shown) to rotate in a direction opposite to the rotation (moving) direction of the photoreceptor 41.

In the intermediate transfer belt 50, four primary transfer sections 51 are arranged in positions facing the respective photoreceptors 41 of the four image forming units 40Y, 40M, 40C, 40K. Each primary transfer section 51 applies a voltage having a polarity opposite to that of toner to the intermediate transfer belt 50, to thereby transfer the toner adhering on the photoreceptor 41 to the intermediate transfer belt 50.

Thus, due to the rotation of the intermediate transfer belt 50, four toner images respectively formed by the four image forming units 40Y, 40M, 40C, 40K are sequentially transferred to the surface of intermediate transfer belt 50. Consequently, a toner image of yellow, a toner image of magenta, a toner image of cyan, and a toner image of black are superimposed on the intermediate transfer belt 50 to thereby form a color image.

Further, a belt cleaning device 53 faces the intermediate transfer belt 50. The belt cleaning device 53 cleans the surface of the intermediate transfer belt 50 that has finished transferring the toner image to the sheet S.

A secondary transfer section 60 is arranged near the intermediate transfer belt 50 and on the downstream side of the conveying section 23 in the sheet conveying direction. The secondary transfer section 60 causes the sheet S conveyed by the conveying section 23 to contact the intermediate transfer belt 50, so that the toner image formed on the outer surface of the intermediate transfer belt 50 is transferred to the sheet S.

The secondary transfer section 60 has a secondary transfer roller 61. The secondary transfer roller 61 is brought into pressure contact with a counter roller 52. The contact portion between the secondary transfer roller 61 and the intermediate transfer belt 50 becomes a secondary transfer nip 62. The position of the secondary transfer nip 62 is the transfer position where the toner image formed on the outer surface of the intermediate transfer belt 50 is transferred to the sheet S.

The fixing section 80 is arranged on the sheet S ejection side of the secondary transfer section 60. The fixing section 80 presses and heats the sheet S to fix the transferred toner image onto the sheet S. The fixing section 80 is configured by, for example, an upper fixing roller 81 and a lower fixing roller 82, which are a pair of fixing members. The upper fixing roller 81 and the lower fixing roller 82 are arranged in a state where they are brought into pressure contact with each other, so that a fixing nip is formed as a pressure-contact portion between the upper fixing roller 81 and the lower fixing roller 82.

A heater is provided within the upper fixing roller 81. A roller portion of the upper fixing roller 81 is heated by the heat radiated from the heater. The heat of the roller portion of the upper fixing roller 81 is transferred to the sheet S, and thereby the toner image on the sheet S is heat-fixed.

The sheet S is conveyed so that the surface having the toner image transferred thereto by the secondary transfer section 60 (i.e., the surface to be subjected to heat-fixing) faces the upper fixing roller 81, and passes through the fixing nip. Thus, when the sheet S passing through the fixing nip is pressed by the upper fixing roller 81 and the lower fixing roller 82, it is heated by the roller portion of the upper fixing roller 81.

A switching gate 24 is arranged on the downstream side of the conveying direction of the sheet S of the fixing section 80. The switching gate 24 switches the conveying path of the sheet S passed through the fixing section 80. To be specific, when ejecting the sheet S with the image side facing up in the case of forming an image on one side of the sheet S, the switching gate 24 will cause the sheet S to go straight ahead. Therefore, the sheet S is ejected by a pair of sheet ejecting rollers 25. Further, when ejecting the sheet S with the image side facing down in the case of forming image on one side of the sheet S, or when forming images on both sides of the sheet S, the switching gate 24 will guide the sheet S downward.

Further, when ejecting the sheet S with the image side facing down, after the sheet S has been guided downward by the switching gate 24, the sheet S will be reversed and conveyed upward by a sheet reversing and conveying section 26.

Therefore, the reversed sheet S is ejected by the pair of sheet ejecting rollers 25. When forming images on both sides of the sheet S, after the sheet S has been guided downward by the switching gate 24, the sheet S will be reversed by the sheet reversing and conveying section 26, and then the reversed sheet S will be sent to the transfer position again by a sheet re-feeding path 27.

Alternatively, a post-processing device may be arranged on the downstream side of the pair of the sheet ejecting rollers 25, wherein the post-processing device is adapted to perform folding processing, stapling processing and the like on the sheet S.

[Image Stabilization Control]

In the aforesaid electrophotographic image forming apparatus 1, an image stabilization control for adjusting the age forming condition is performed so that the density of the image to be formed (the output image) becomes a target density. Examples of the image forming condition include charging voltage, exposure amount, developing bias voltage and the like. The image stabilization control is performed by forming an image-adjusting pattern image on an image carrier (such as the intermediate transfer belt 50 or the like) or a recording medium (such as the sheet S or the like), detecting the density of the image-adjusting pattern image by a detector, and feeding back the detection result to the image forming condition, so that the detection result is reflected in the image forming condition.

The image-adjusting pattern image, as a patch-like toner pattern image (hereinafter referred to as "toner patch image") for example, is formed on the image carrier (such as the intermediate transfer belt 50 or the like) or the recording medium (such as the sheet S or the like). Described here is a case where a toner patch image is recorded on the sheet S. The toner patch image includes four colors of patch rows corresponding to the four colors of the toner images, i.e., yellow (Y), magenta (M), cyan (C), and black (K).

Figure 2:
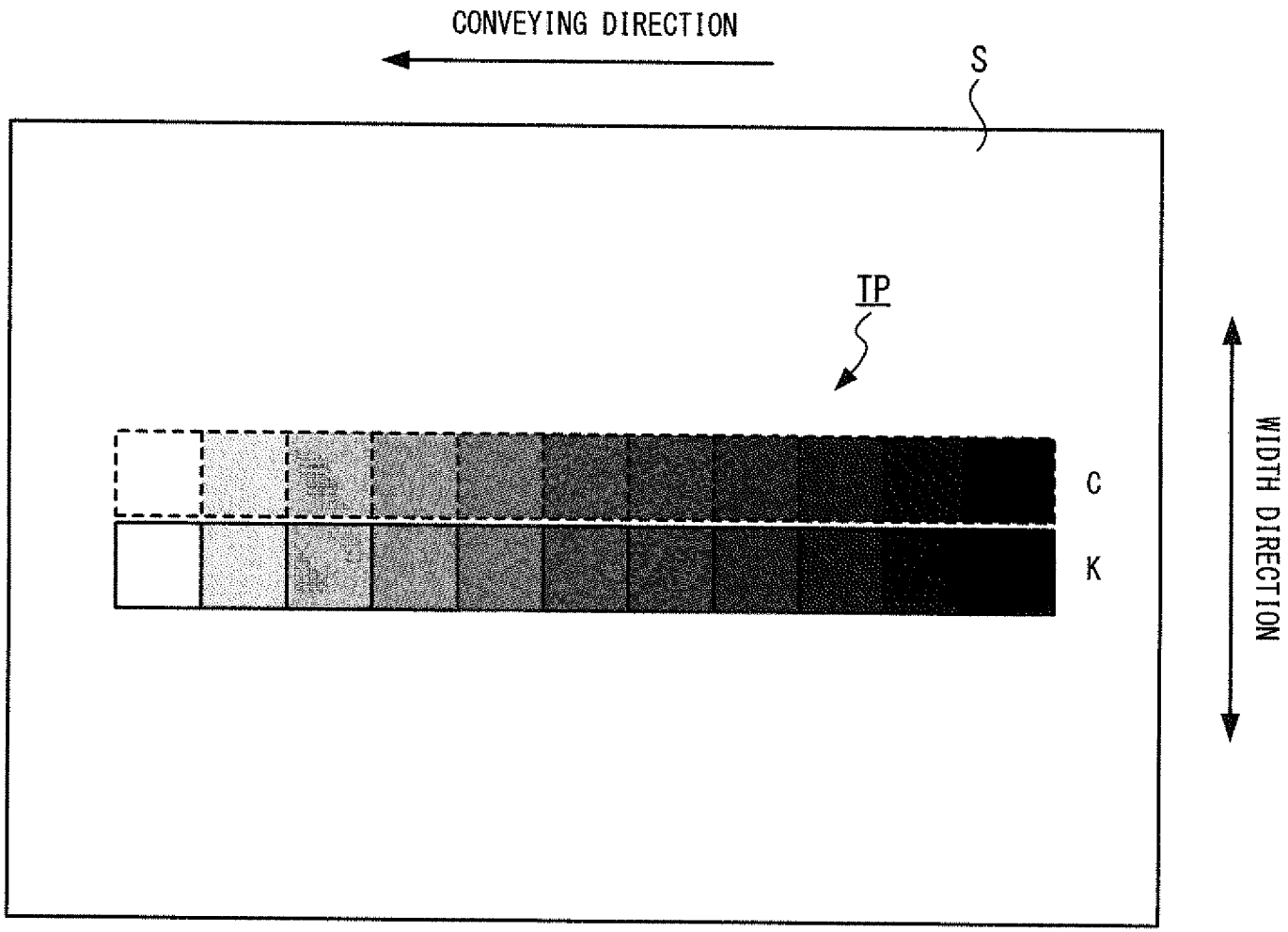
FIG. 2 is a view showing a toner patch image, which is an example of an image-adjusting pattern image.

To be more specific, as shown in FIG. 2, a toner patch image TP is configured by a plurality of patch rows, each patch row including a plurality of patches linearly arrayed for each color of YMCK. The plurality of patch rows of respective colors are formed adjacent to each other on the sheet S. Note that, for sake of simplicity, only two colors of patch rows (i.e., a patch row of cyan (C) and a patch row of black (K) for example) of the toner patch image TP are shown in FIG. 2.

In FIG. 2, a plurality of patches of the patch row of cyan are shown by squares indicated by broken line, and a plurality of patches of the patch row of black are shown by squares indicated by solid line. The plurality of patches of the patch row of each color are arrayed so that the toner density thereof changes sequentially in the conveying direction of the sheet S (i.e., so that the toner density thereof becomes thinner or denser sequentially in the conveying direction of the sheet S).

The toner patch image TP is formed within an image forming area specified for each sheet S. In the present embodiment, for example, a central portion in the width direction of the sheet S (i.e., the direction perpendicular to the conveying direction of the sheet S) is the formation area of the toner patch image TP (i.e., the formation area of the image-adjusting pattern image). However, the formation area of the toner patch image TP is not necessarily to be set within the image forming area of the sheet S, but may also be set outside the image forming area. Incidentally, the width direction of the sheet S is also the main scanning direction in image formation, and the conveying direction of the sheet S is also the sub-scanning direction in image formation.

On the other hand, the detector for detecting information such as the color, density and the like of the image-adjusting pattern image (i.e., the toner patch image TP) has a well-known optical toner density sensor. As described above, the image stabilization control for reflecting (feeding back) the detection result of the toner density sensor to (in) the image forming condition include two methods, which are the image stabilization control method (1) and the image stabilization control method (2).

As shown in FIG. 1, the image stabilization control method (1) is a method in which the toner density of an unfixed image-adjusting pattern image formed on the intermediate transfer belt 50 is detected by a toner density sensor 110 located on the downstream side of the secondary transfer section 60 and arranged so as to face the intermediate transfer belt 50; and the image stabilization control method (2) is a method in which the toner density of the image-adjusting pattern image fixed onto the sheet S is detected by a toner density sensor 120 arranged facing the sheet conveying section provided on the downstream side of the fixing section 80.

The toner density sensor 110 used in the image stabilization control method (1) is an optical sensor adapted to detect, in terms of spot, the density of a specific position of the image formed on the intermediate transfer belt 50. In contrast, the toner density sensor 120 used in the image stabilization control method (2) is an optical sensor capable of detecting the information of the image fixed onto the sheet S over the entire area in the width direction of the sheet S (i.e., the direction perpendicular to the conveying direction of the sheet S).

To be specific, the toner density sensor 120 includes, for example, a sensor whose pixels are linearly arranged over the entire area in the width direction of the sheet S (i.e., a so-called "line sensor"), a light source for irradiating light to the image fixed onto the sheet S, and an optical system adapted to guide the light reflected from the fixed image to the line sensor based on the light irradiated from the light source. The line sensor may either be a CCD type image sensor or a CMOS type (including a MOS type) image sensor.

This type of toner density sensor 120 may also be referred to as an "in-line sensor". In addition to the toner density sensor 120 having the line sensor, the detector for detecting the toner density of the toner patch image TP also includes a signal processing section for processing the output of the toner density sensor 120 (wherein the output of the toner density sensor 120 is in pixel unit), and is configured so as to be able to detect, not in terms of "spot" but in terms of "area", the color information, the print position information and the like of the image fixed onto the sheet S over the entire area in the width direction of the sheet S.

Further, the detector is configured so as to be able to arbitrarily set a detection area in the width direction of the sheet S. To be specific, a specific area can be set as the detection area by, for example, selecting pixels in a specific area but not selecting pixels in other area of the line sensor, or by outputting, when the signal processing section performs signal processing, the signal of the pixels in the specific area but not outputting the signal of the pixels in the other area of the line sensor.

As described above, with the image stabilization control method (2) in which the toner density sensor 120 capable of detecting the fixed image over the entire area in the width direction of the sheet S is used, it is possible to detect more information about the image (including the fluctuation generated in the secondary transfer section 60 and the fixing section 80, for example) and reflect such information in the image forming condition. Thus, with the image stabilization control method (2), high image quality can be achieved compared with the image stabilization control method (1) with which the fluctuation generated in the secondary transfer section 60 and the fixing section 80 can not be detected.

In the image forming apparatus 1 according to the present embodiment, the image stabilization control method (1) and the image stabilization control method (2) are both adopted. However, the image stabilization control method (1) does not have to be adopted. In other words, the present invention can be applied to an image forming apparatus in which at least the image stabilization control method (2) is adopted.

Here, the image stabilization control method (2) will be described below with reference to the conceptual diagram of the gradation characteristic shown in FIG. 3. In the conceptual diagram of the gradation characteristic, the horizontal axis represents the input gradation of the image data, and the vertical axis represents the density value detected by the toner density sensor 120.

Figure 3:
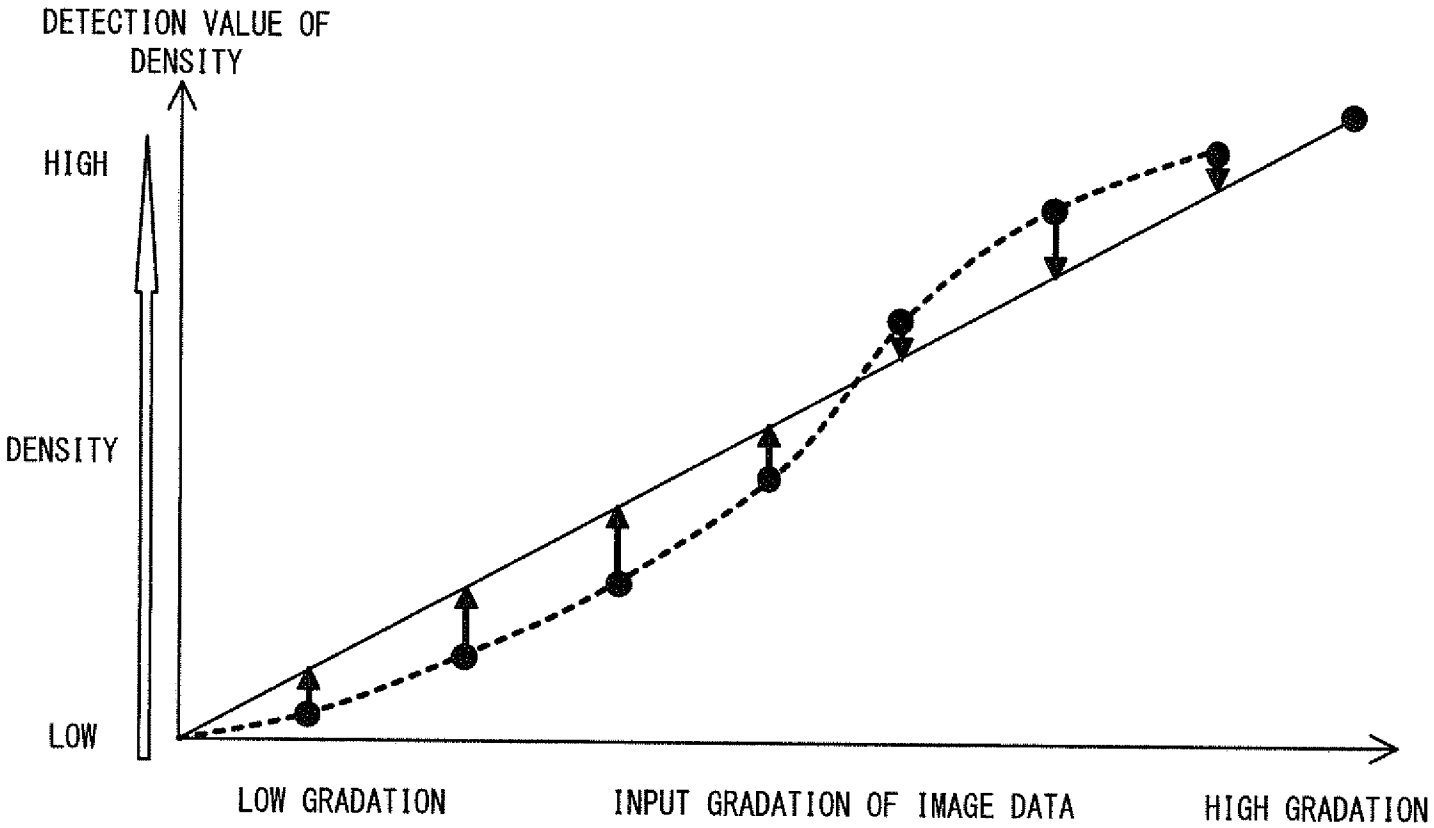
FIG. 3 is a conceptual diagram of gradation characteristic.

In FIG. 3, the characteristic indicated by the solid line represents a target gradation characteristic. Due to various factors such as unevenness of the fixing temperature of the fixing section 80, the density value detected by the toner density sensor 120 varies from the target gradation characteristic so that, for example, on the low-gradation side, the density value detected by the toner density sensor 120 varies toward low-density side, and on the high-gradation side, the density value detected by the toner density sensor 120 varies toward high-density side, as shown by the characteristic in FIG. 3.

In the image stabilization control method (2), a control is performed in which a correction value is calculated based on the density value detected by the toner density sensor 120, the calculated correction value is fed back to the image forming condition of the image forming section 40. The correction value calculated in such control is equivalent to the difference between the target gradation characteristic shown by the solid line in FIG. 3 and the density value actually detected by the toner density sensor 120 (i.e., the length of the arrow in FIG. 3).

However, due to various factors, there is a possibility that temperature unevenness may be caused in the axial direction of the fixing rollers (i.e., the upper fixing roller 81 and the lower fixing roller 82 shown in FIG. 1) of the fixing section 80 (note that the "axial direction of the fixing rollers of the fixing section 80" may be simply referred to as "axial direction of the fixing section" hereinafter). Further, if there is temperature unevenness in the axial direction of the fixing section 80, the influence of the phenomenon of thermochromism caused by the temperature unevenness will be exerted.

Figure 4:
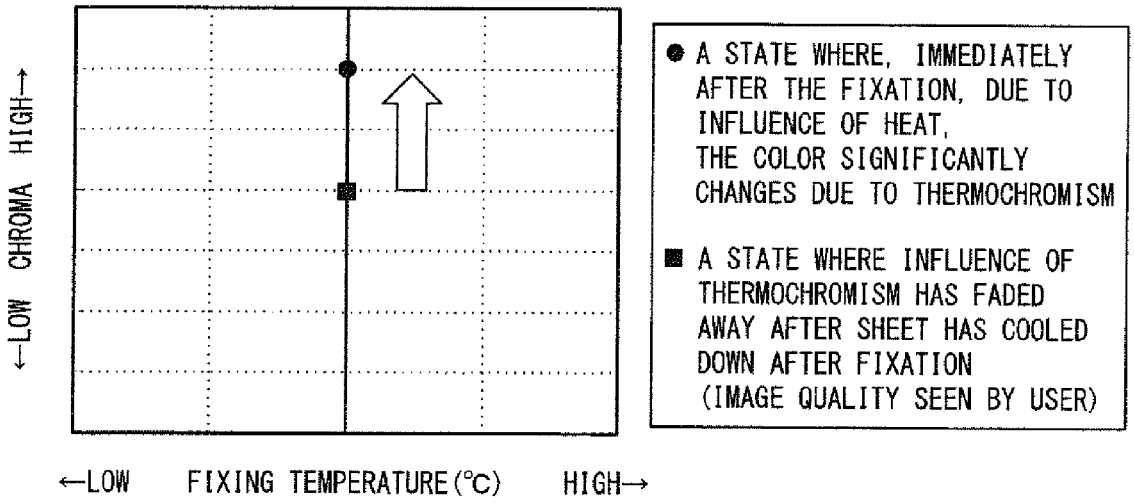
FIG. 4 is a view showing the situation where the color changes due to the influence of the phenomenon of thermochromism.
Figure 5:
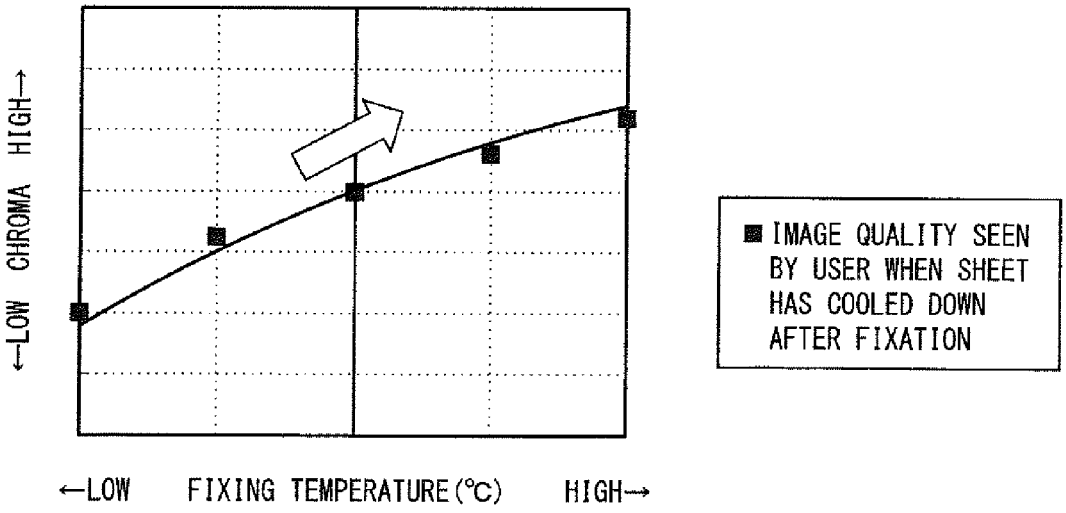
FIG. 5 is a view showing the relationship between fixing temperature and chroma.

Two phenomena of color change of image related to fixation will be described below with reference to the FIG. 4 and FIG. 5.

Immediately after the toner has been fixed onto the sheet S, due to the heat applied to the image, the color of the toner will temporarily change owing to the influence of the phenomenon of thermochromism. The phenomenon of thermochromism occurs when a material is heated, due to the heating temperature, the molecular structure of the material changes from a planar structure to a tetrahedral structure and thereby electron configuration changes, so that wavelength to absorb the light changes even if for the same material. Since thermochromism is a reversible phenomenon, when the temperature of the sheet has gone down, the image will turn back into its original color, and the color of the image will be stable. Such situation (i.e., the situation where the color changes due to the influence of the phenomenon of thermochromism) is shown in FIG. 4.

When the toner is being fixed onto the sheet S, if the fixing temperature is high, the way for toner to melt into (to be crashed by) the fibers of the sheet S changes, and therefore the degree of the absorption of the toner layer inside the fibers changes, so that the color changes. Generally, the higher the fixing temperature is, the higher the chroma will become. This is a unique phenomenon of an electrophotography. FIG. 5 is a view showing the relationship between the fixing temperature and the chroma.

[Influence of Thermochromism]

Here, the influence of the phenomenon of thermochromism will be concretely described below with reference to FIG. 6 which shows the relationship between the fixing temperature and the color both in a normal state where the sheet S is cold and in a state where the phenomenon of thermochromism is caused.

Figure 6:
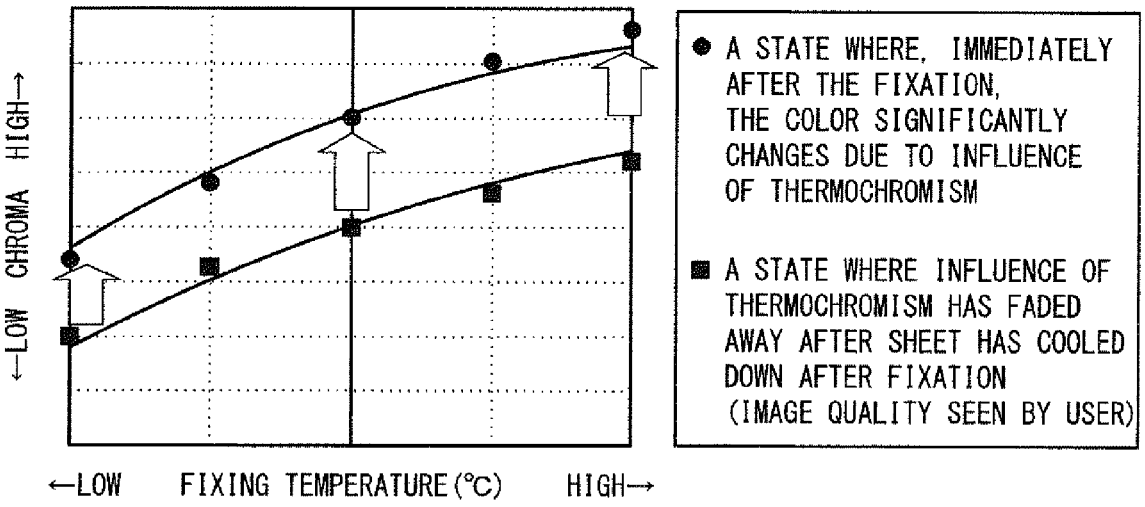
FIG. 6 is a view showing the relationship between the fixing temperature and color both in a normal state where the sheet is cold and in a state where the phenomenon of thermochromism is caused.

In FIG. 6, the mark "●" represents a state where, immediately after fixation, the color of the image significantly changes due to the phenomenon of thermochromism, and the mark "■" represents a state where the sheet S has cooled down after fixation, and therefore the influence of thermochromism has fades away. The state shown by the mark "■" is the image quality seen by the user.

When information about the color, density and the like of the fixed image is detected by the toner density sensor 120 arranged on the downstream side of the fixing section 80, if the sheet S is immediately after passing through the fixing section 80, due to the influence of the phenomenon of thermochromism, the color will change compared with the image quality seen by the user. To be specific, as shown in FIG. 6, due to the phenomenon of thermochromism, the color of the image will change in a direction in which the chroma becomes higher regardless of fixing temperature.

Also, since the fixing section 80 has a temperature difference in the axial direction of the fixing rollers (81, 82) and thereby the degree of the influence of the phenomenon of thermochromism changes due to the temperature unevenness in the axial direction, the color of the image will further change. To be specific, as shown in FIG. 6, due to the temperature unevenness of the fixing temperature in the axial direction, the color of the image will change so that the chroma becomes lower in the area where the fixing temperature is lower (i.e., the length of the arrow in the drawing becomes shorter), and the chroma becomes higher in the area where the fixing temperature is higher (i.e., the length of the arrow in the drawing becomes longer).

[Factors which Contribute to Occurrence of Temperature Unevenness in Axial Direction]

Here, one of factors which contribute to occurrence of the temperature unevenness in axial direction will be described below based on examples of situations where a user actually uses the image forming apparatus 1.

Examples of situations where the temperature unevenness in the axial direction of the fixing section 80 is generated include a case where a large size sheet S2 passes through the fixing rollers of the fixing section 80 after a large number of small size sheets S1 has passed through the fixing rollers of the fixing section 80.

Figure 7A:
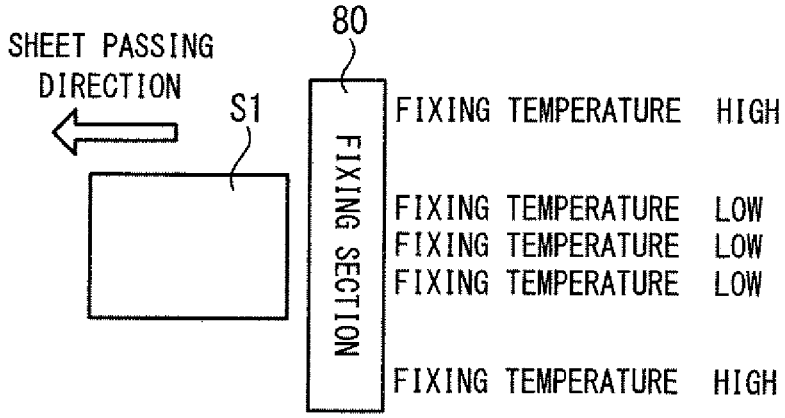
FIGS. 7A, 7B and 7C are views for explaining one of factors which contribute to occurrence of temperature unevenness of the fixing temperature of a fixing section in the axial direction.

In such a case, when a large number of small size sheets S1 pass through the fixing rollers of the fixing section 80, the fixing temperature of the fixing section 80 will change in the axial direction. To be specific, as shown in FIG. 7A, in the area of a central portion of the fixing rollers of the fixing section 80 through which the sheets S1 pass, since heat is absorbed by the sheets S1, the fixing temperature becomes relatively low; whereas in the area of both end portions of the fixing rollers of the fixing section 80 through which the sheets S1 do not pass, since heat is not absorbed by the sheets S1, the fixing temperature becomes relatively high.

Figure 7B:
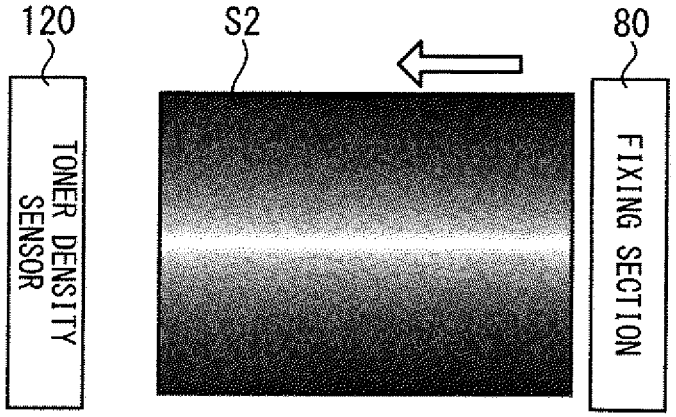

In such a manner, as shown in FIG. 7B, when the sheet S2 with larger width has passed through the fixing section 80 in a state where the temperature unevenness in the axial direction of the fixing section 80 is generated, the color of the both end portions of the sheet S2 in the axial direction having passed through the portions of the fixing rollers with higher fixing temperature will become relatively dark, and the color of the central portion of the sheet S2 in the axial direction having passed through the portion of the fixing rollers with lower fixing temperature will become relatively light.

Figure 7C:
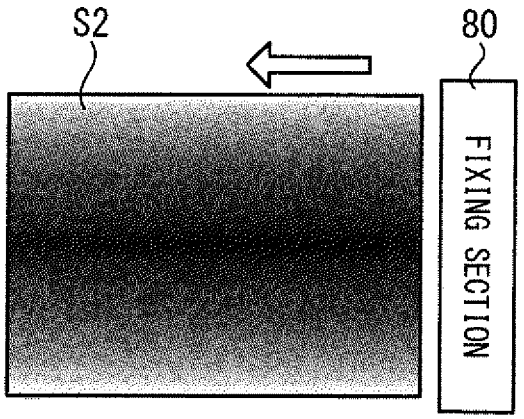

Further, the image formed on the sheet S2 is detected by the toner density sensor 120, and the detection result is fed back to the image forming condition, and thereby the density is adjusted. When forming a normal image in such a state, since image the forming condition is changed by, for example, reducing the amount of the toner to be supplied to talent image to be formed in the end portions of the sheet, the color of the end portions of the sheet S2 in the axial direction will become light, as shown in FIG. 7C, and that is a problem.

To solve such a problem, in the image forming apparatus 1 according to the present embodiment, when performing the feed back control to reflect the detection result obtained by the detector arranged on the downstream side of the fixing section 80 in the image forming condition, first the temperatures of a plurality of points in the fixing rollers of the fixing section 80 in the axial direction are detected by a fixing temperature detector.

Then, based on the temperature detection values obtained by the fixing temperature detector, a detection area where the detector detects the toner patch image TP (referred to as "detection area of the detector" hereinafter) is set so that the toner patch image TP located in a place where the fixing temperature is equal to a desired temperature is detected, and the image forming condition is determined based on the detection result of the toner patch image TP obtained in the detection area set as above. In other words, the detection result of the toner patch image TP obtained by the detector is fed back to the image forming condition of the image forming section 40, so that the detection result is reflected in the image forming condition.

Figure 8:
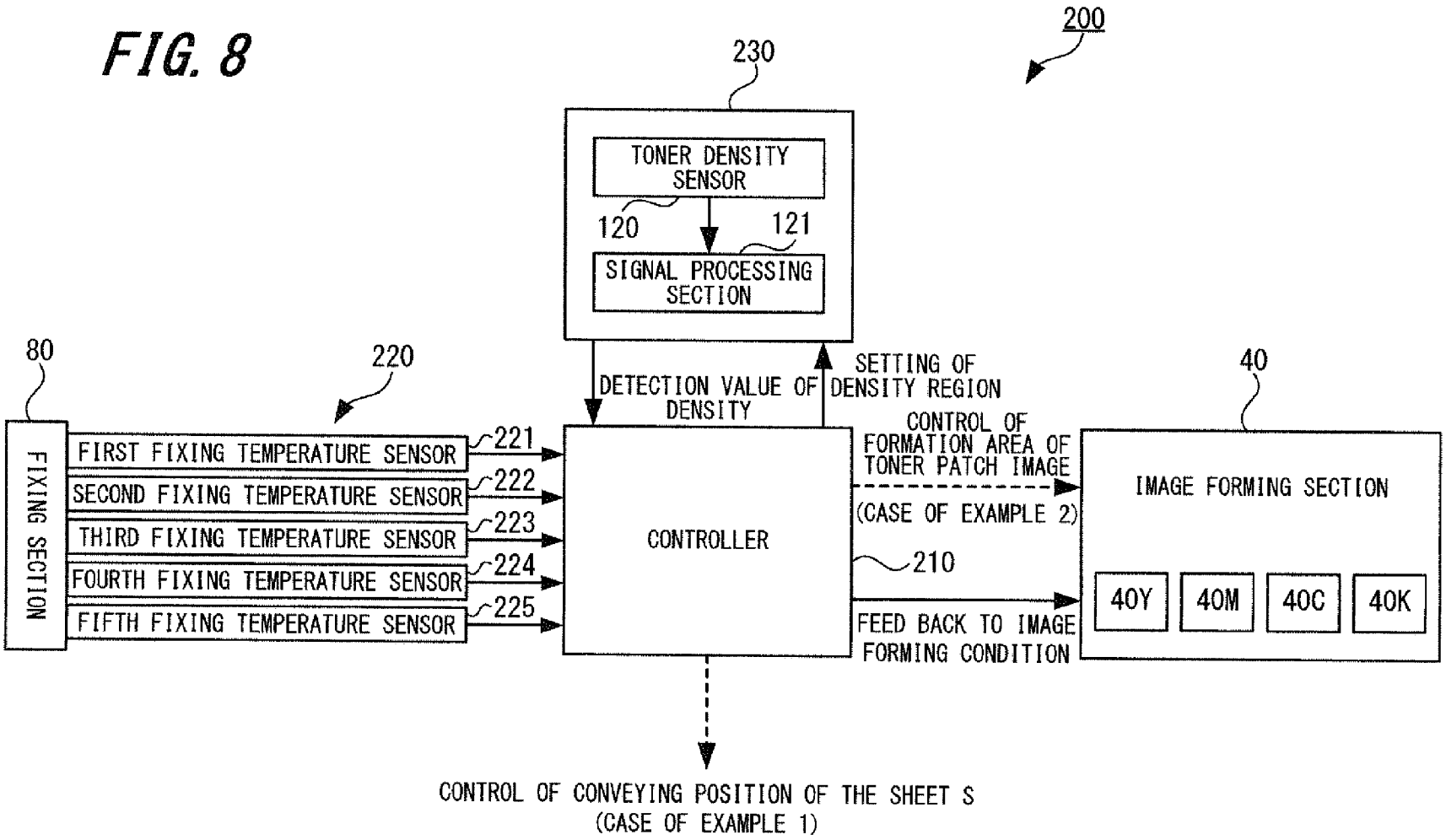
FIG. 8 is a block diagram showing an example of the configuration of a control system that performs control on setting detection area of the toner patch image.

FIG. 8 is a block diagram showing an example of the configuration of a control system that performs control on setting the detection area of the toner patch image TP and the like.

As shown in FIG. 8, the control system 200 includes the image forming section 40, a controller 210, a fixing temperature detector 220 and a detector 230, wherein the image forming section 40 includes the four image forming units 40Y, 40M, 40C, 40K, and the detector 230 includes the toner density sensor 120.

The controller 210 also serves as a controller for controlling the whole system of the image forming apparatus 1, and can be configured by, for example, a microcomputer. However, the controller 210 does not have to be configured by a microcomputer, but may also be configured by hardware.

The fixing temperature detector 220 includes a plurality of fixing temperature sensors for detecting the temperature of a plurality of points in the axial direction of the fixing rollers (the upper fixing roller 81 and the lower fixing roller 82 in FIG. 1) of the fixing section 80, and in the present embodiment, the plurality of fixing temperature sensors are a first fixing temperature sensor 221, a second fixing temperature sensor 222, a third fixing temperature sensor 223, a fourth fixing temperature sensor 224, and a fifth fixing temperature sensor 225. A well-known temperature sensor may be used as each of the fixing temperature sensors 221 to 225.

Based on the temperature detection values of the five fixing temperature sensors 221 to 225, the controller 210 sets the detection area of the detector 230 so that the toner patch image TP located in a place where the fixing temperature is equal to the desired temperature is detected. Further, the controller 210 reflects the detection result of the toner patch image TP detected in the detection area in the image forming condition of the image forming section 40 to thereby determine the image forming condition.

In addition to aforesaid two functions, the controller 210 may also have other two functions depending on different control form. One function is to change (control), if the control form is Example 1 (which is to be described later), the conveying position of the sheet S in the axial direction of the fixing section 80 (i.e., the direction perpendicular to the conveying direction of the sheet S). The other function is to change (control), if the control form is Example 2 (which is to be described later), the formation area of the toner patch image TP in the axial direction of the fixing section 80, wherein the formation area is an area where the toner patch image TP is to be formed onto the sheet S by the image forming section 40.

In addition to the toner density sensor 120, the detector 230 also includes a signal processing section 121 adapted to process the output of the toner density sensor 120 (wherein the output of the toner density sensor 120 is in pixel unit). The detector 230 can detect, in terms of area, the color information, the print position information and the like of the image fixed onto the sheet S over the entire area in the width direction of the sheet S.

The detector 230 is configured so as to be able to arbitrarily set a detection area in the width direction of the sheet S by, for example, selecting pixels in a specific area of the line sensor, or outputting, when signal processing is being performed by the signal processing section 121, the signal of the pixels in the specific area.

When the controller 210 has finished the setting of the detection area of the detector 230, the image forming section 40 will form the toner patch image TP, and the detector 230 will detect the toner patch image TP having been fixed onto the sheet S.

At this time, since the detection area of the detector 230 has been set so that the toner patch image TP located in a place where the fixing temperature is equal to the desired temperature is detected, the toner patch image TP is detected in an area not affected by the phenomenon of thermochromism caused by the temperature unevenness in the axial direction of the fixing section 80. The controller 210 reflects (feeds back) the detection result of the toner patch image TP obtained by the detector 230 in (to) the image forming condition of the image forming section 40 to thereby determine the image forming condition.

As described above, by setting, based on the temperature detection values of the plurality of points in the axial direction of the fixing section 80, the detection area of the detector 230 so that the toner patch image TP located in a place where the fixing temperature is equal to the desired temperature is detected, it is possible to detect the toner patch image TP in an area not affected by the phenomenon of thermochromism caused by the temperature unevenness in the axial direction of the fixing section 80. Thus, in the state where the phenomenon of thermochromism is caused, even if there is temperature unevenness in the axial direction of the fixing section 80, it is possible to correctly detect the information about the fixed image while suppressing the influence of the temperature unevenness, and reflect the detection result in the image forming condition.

Incidentally, although the present embodiment is described based on a configuration in which the temperatures at the five points in the axial direction of the fixing section 80 are detected by the five fixing temperature sensors 221 to 225, the present invention is not limited to such configuration. For example, the number of the fixing temperature sensors may be further increased, so that by detecting the temperatures of more points in the axial direction of the fixing section 80, detection accuracy of the fixing temperatures in the axial direction of the fixing section 80 can be improved.

Concrete examples (Example 1 to Example 3) of the present embodiment will be described below.

EXAMPLE 1

Figure 9:
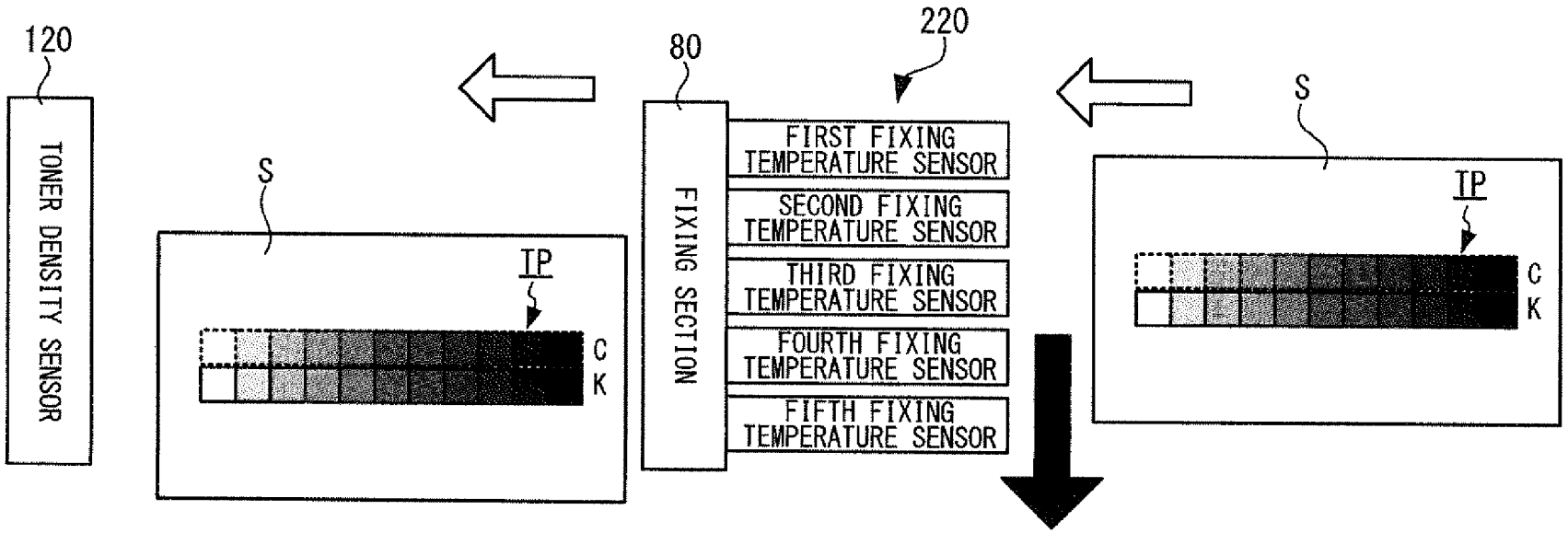
FIG. 9 is a view for explaining Example 1.

FIG. 9 is a view for explaining Example 1. In Example 1, the fixing temperatures of a plurality of points in the axial direction of the fixing section 80 are detected by, for example, five fixing temperature sensors 221 to 225 arranged in the axial direction of the fixing section 80. Further, based on the distribution of the temperature detection values of the fixing temperature sensors 221 to 225 in the axial direction of the fixing section 80, a place where the fixing temperature is closest to the desired temperature is identified, and the detection area of the detector 230 is set at the identified place.

Further, in response to the setting of the detection area of the detector 230, the conveying position of the sheet S is changed in the axial direction of the fixing section 80 so that the toner patch image TP is located in the place where the fixing temperature is closest to the desired temperature. By changing the conveying position of the sheet S, it becomes possible for the detector 230 to detect the toner patch image TP fixed onto the sheet S at the desired temperature.

When setting the detection area of the detector 230 and accordingly changing the conveying position of the sheet S, the following arithmetic processing (i.e., arithmetic processing for calculating difference between each temperature detection value and the desired temperature) is performed on the temperature detection value of each of the five fixing temperature sensors 221 to 225.

|temperature detection value of first fixing temperature sensor−desired temperature|

|temperature detection value of second fixing temperature sensor−desired temperature|

|temperature detection value of third fixing temperature sensor−desired temperature|

|temperature detection value of fourth fixing temperature sensor−desired temperature|

|temperature detection value of fifth fixing temperature sensor−desired temperature|

Such arithmetic processing will be performed in the same manner in Examples 2 and 3, which are to be described later. Further, the conveying position of the sheet S is changed in the axial direction of the fixing section 80 so that the toner patch image TP is located in the place of the fixing temperature sensor whose result of the arithmetic processing is closest to zero (i.e., whose temperature detection value is closest to the desired temperature). In such manner, the sheet S passes through the fixing section 80 after the conveying position of the sheet S has been changed in the axial direction of the fixing section 80.

The example shown in FIG. 9 is an example in which the central area of the sheet S in the axial direction is a reference formation area of the toner patch image TP, and the temperature detection value of the fourth fixing temperature sensor is identified to be closest to the desired temperature. At this time, the conveying position of the sheet S is changed in the axial direction of the fixing section 80 (i.e., the direction indicated by the black arrow in FIG. 9) so that the formation area of the toner patch image TP is located in the place of the fourth fixing temperature sensor.

It is preferred that, when changing the conveying position of the sheet S, the central position of the formation area of the toner patch image TP in the width direction of the sheet S is substantially located at the center of the fourth fixing temperature sensor. In the present example, the conveying position of the sheet S is changed so that the boundary between the patch row of cyan (C) and the patch row of black (K) of the toner patch image TP comes to the center of the fourth fixing temperature sensor.

When the detector 230 detects the information about the toner patch image TP, the sheet S passes through the fixing section 80 after the sheet S has been moved in the axial direction of the fixing section 80 so that the reference formation area of the toner patch image TP is located in the place of the fourth fixing temperature sensor.

In the case of Example 1, since it is necessary to change the conveying position of the sheet S in the axial direction of the fixing section 80, the controller 210 shown in FIG. 8 also performs a control to change the conveying position of the sheet S in the axial direction of the fixing section 80. The changing of the conveying position of the sheet S can be performed in the conveying path between the time when the sheet S comes out from the secondary transfer section 60 and the time when the sheet S enters the fixing section 80.

Figure 10:
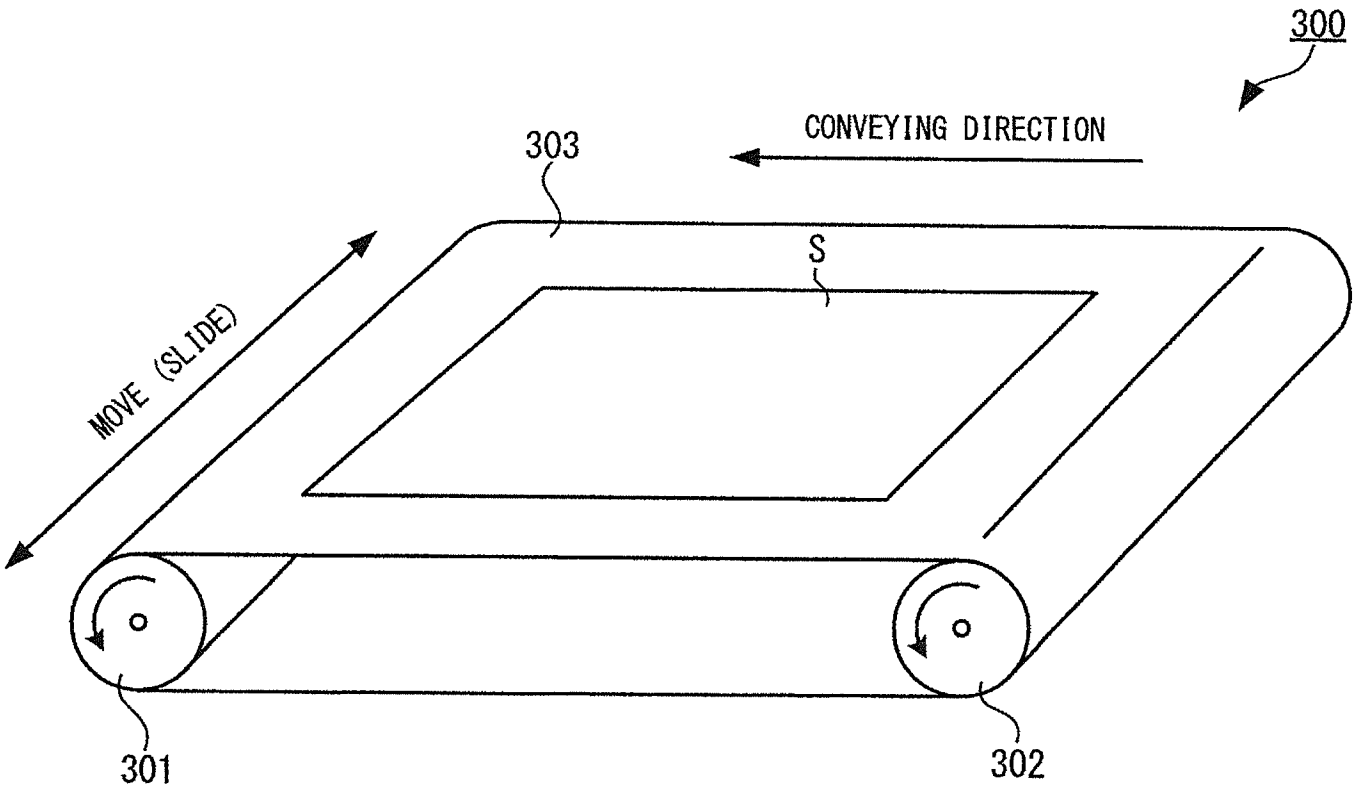
FIG. 10 is a perspective view showing an example of a mechanism for moving the sheet in the axial direction of the fixing section.

For example, as shown in FIG. 10, a conveying mechanism 300 is movably arranged in a conveying path on the upstream side of the fixing section 80 so as to be able to move in a direction perpendicular to the conveying direction, wherein the conveying mechanism 300 includes a front conveying roller 301, a rear conveying roller 302, and an endless conveying belt 303 wrapped around the conveying rollers 301, 302. The conveying mechanism 300 is moved (slid) by a slide mechanism (not shown), and thereby the conveying position of the sheet S can be changed in the axial direction of the fixing section 80. The size of the upper face of the conveying mechanism 300 needs to be equal to or larger than the maximum size of the sheet S.

Figure 11:
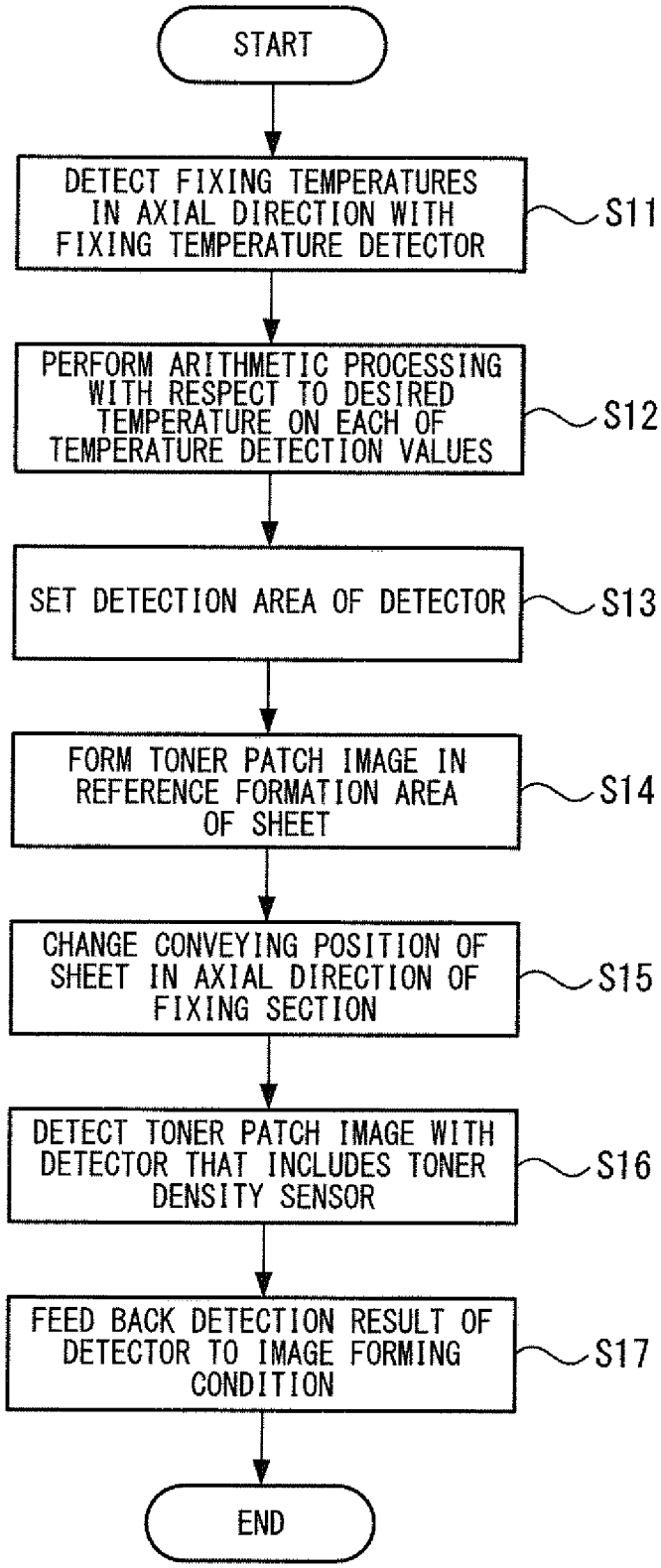
FIG. 11 is a flowchart showing the flow of concrete processing of Example 1.

The flow of the concrete processing of Example 1 will be described below with reference to the flowchart of FIG. 11. Such processing is performed under the control of the controller 210.

When performing the control to determine the image forming condition based on the detection result of the detector 230 (which includes the toner density sensor 120), first, the fixing temperature detector 220 detects the fixing temperatures of the plurality of points in the axial direction of the fixing section 80 (step S11).

Next, the aforesaid arithmetic processing (i.e., arithmetic processing for calculating difference between the temperature detection value and the desired temperature) is performed on the temperature detection value of each of the five fixing temperature sensors 221 to 225, for example, of the fixing temperature detector 220 (step S12). Next, based on a temperature distribution of in the axial direction of the fixing section 80, a place where the fixing temperature is closest to the desired temperature is identified, and the detection area of the detector 230 is set at the identified place (step S13), wherein the temperature distribution is obtained based on the temperature detection values of the fixing temperature sensors 221 to 225.

Next, in the image forming section 40, a toner patch image TP is formed in the reference formation area of the sheet S (step S14). Next, before the sheet S, on which the toner patch image TP has been formed, has entered the fixing section 80, the conveying position of the sheet S is changed in the axial direction of the fixing section 80 in response to the setting of the detection area of the detector 230, so that the toner patch image TP is located in the place where the fixing temperature is the desired temperature (step S15).

Next, information about the color, density and the like of the toner patch image TP fixed onto the sheet S is detected by the detector 230 (which includes the toner density sensor 120) arranged on the downstream side of the fixing section 80 (step S16). Next, the detection result of the detector 230 is fed back to the image forming condition of the image forming section 40, and thereby the image forming condition is determined (step S17).

EXAMPLE 2

Figure 12:
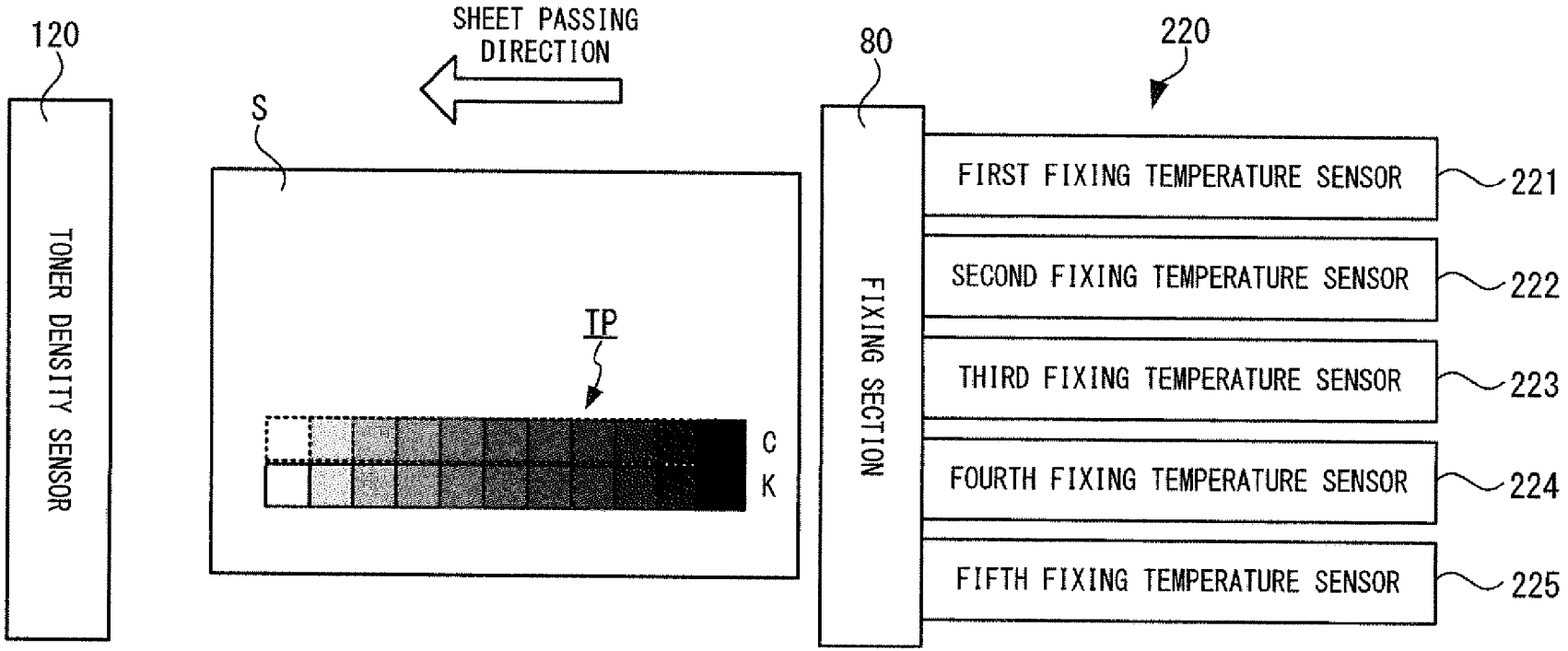
FIG. 12 is a view for explaining Example 2.

FIG. 12 is a view for explaining Example 2. In Example 2, similar to Example 1, the fixing temperatures of a plurality of points in the axial direction of the fixing section 80 are detected by, for example, five fixing temperature sensors 221 to 225 arranged in the axial direction of the fixing section 80. Further, based on a temperature distribution of the fixing section 80 in the axial direction, a place where the fixing temperature is closest to the desired temperature is identified, and the detection area of the detector 230 is set at the identified place, wherein the temperature distribution is obtained based on the temperature detection values of the fixing temperature sensors 221 to 225.

Further, in Example 2, in response to the setting of the detection area of the detector 230, the formation area of the toner patch image TP in the sheet S is changed in the axial direction of the fixing section 80 so that the toner patch image TP is located in the place where the fixing temperature is closest to the desired temperature.

The changing of the formation area of the toner patch image TP in the sheet S is achieved by changing the image data of the toner patch image TP treated in the image forming section 40. By changing the formation area of the toner patch image TP, it becomes possible for the detector 230 to detect the toner patch image TP located in a place where the fixing temperature is equal to the desired temperature.

When setting the detection area of the detector 230 and accordingly changing the formation area of the toner patch image TP, the arithmetic processing described in Example 1 is performed for calculating difference between each of the temperature detection values of the five fixing temperature sensors 221 to 225 and the desired temperature.

The example shown in FIG. 12 is an example in which the central area of the sheet S in the axial direction is a reference formation area of the toner patch image TP, and the temperature detection value of the fourth fixing temperature sensor is identified to be closest to the desired temperature. At this time, the formation area of the toner patch image TP formed in the image forming section 40 is changed in the axial direction of the fixing section 80 so that the formation area of the toner patch image TP is located in the place of the fourth fixing temperature sensor.

It is preferred that, when changing the formation area of the toner patch image TP, the central position of the formation area of the toner patch image TP in the width direction of the sheet S is substantially is located at the center of the fourth fixing temperature sensor. In the present example, the formation area of the toner patch image TP on the sheet S is changed so that the boundary between the patch row of cyan (C) and the patch row of black (K) of the toner patch image TP comes to the center of the fourth fixing temperature sensor.

Figure 13:
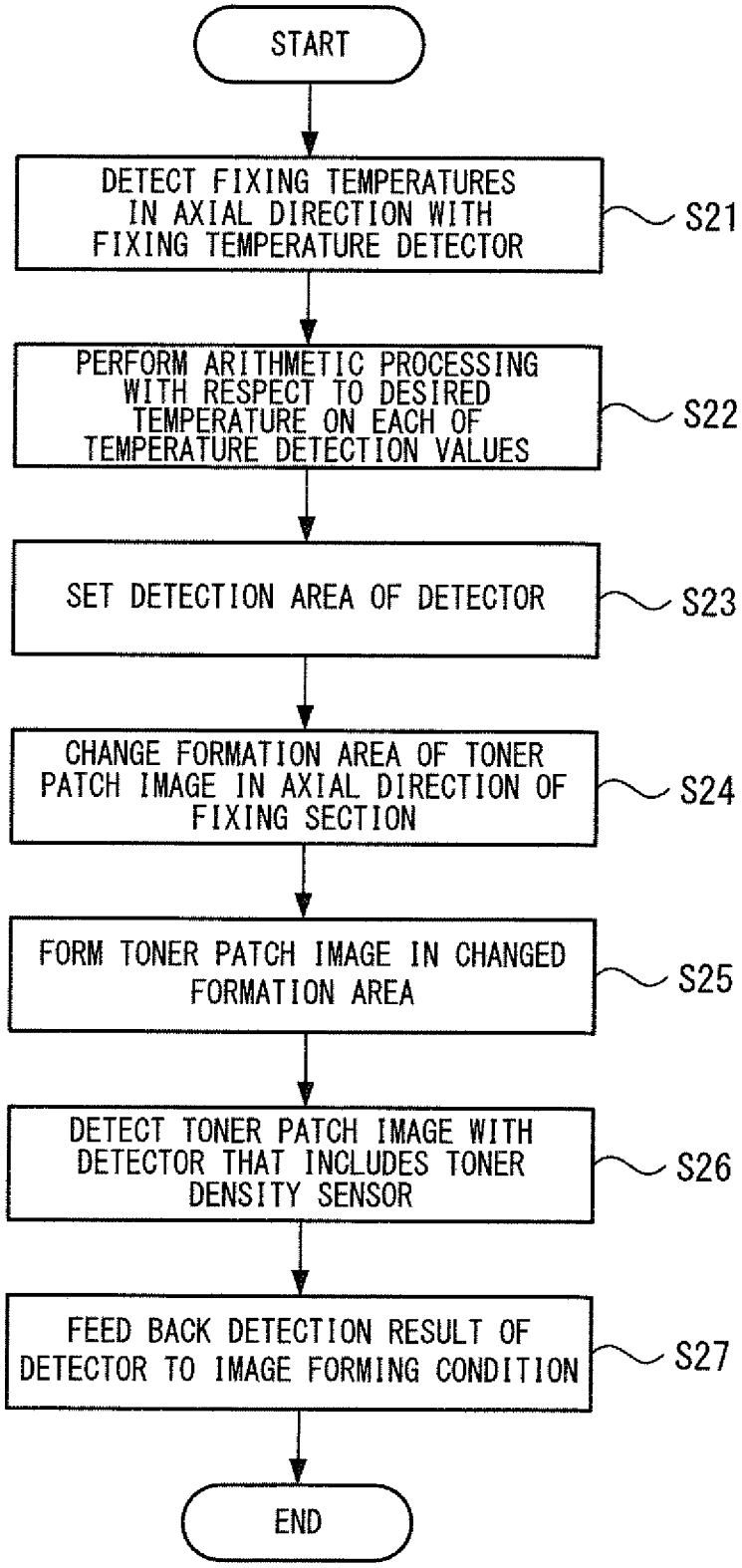
FIG. 13 is a flowchart showing the flow of concrete processing of Example 2.

The flow of the concrete processing of Example 2 will be described below with reference to the flowchart of FIG. 13. Such processing is performed under the control of the controller 210.

When performing the control of determining the image forming condition based on the detection result of the detector 230 (which includes the toner density sensor 120), first, the fixing temperature detector 220 detects the fixing temperatures of the plurality of points in the axial direction of the fixing section 80 (step S21).

Next, the arithmetic processing for calculating difference between the temperature detection value and the desired temperature is performed on the temperature detection value of each of the five fixing temperature sensors 221 to 225, for example, of the fixing temperature detector 220 (step S22). Next, based on a temperature distribution of the fixing section 80 in the axial direction, a place where the fixing temperature is closest to the desired temperature is identified, and the detection area of the detector 230 is set at the identified place (step S23), wherein the temperature distribution is obtained based on the temperature detection values of the fixing temperature sensors 221 to 225.

Next, in response to the setting of the detection area of the detector 230, the formation area of the toner patch image TP to be formed on the sheet S is changed in the axial direction of the fixing section 80 so that the toner patch image TP is located in the place where the fixing temperature is closest to the desired temperature (step S24). Next, in the image forming section 40, a toner patch image TP is formed in the changed formation area (step S25).

Next, information about the color, density and the like of the toner patch image TP fixed onto the sheet S is detected by the detector 230 (which includes the toner density sensor 120) arranged on the downstream side of the fixing section 80 (step S26). Next, the detection result of the detector 230 is fed back to the image forming condition of the image forming section 40, and thereby the image forming condition is determined (step S27).

Modification Of Example 2

Example 2 is a control in which, when the temperature detection value of the fourth fixing temperature sensor is closest to the desired temperature, the formation area of the toner patch image TP is changed in the axial direction of the fixing section 80 so that the formation area of the toner patch image TP is located the place of the fourth fixing temperature sensor. However, such control is merely an example, and the present invention is not limited to such example.

Figure 14:
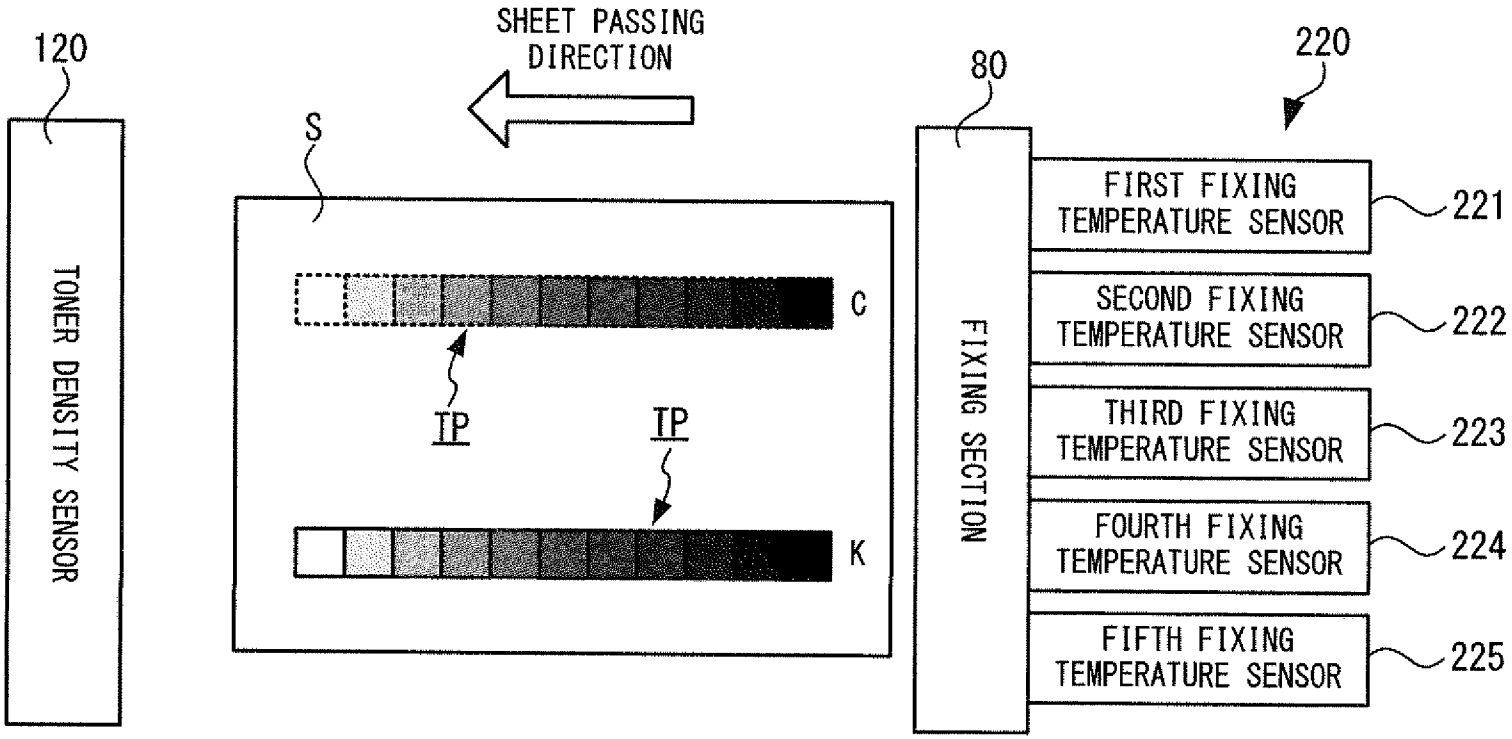
FIG. 14 is a view for explaining a modification of Example 2.

For example, another configuration possible to be adopted is the one in which, when there are two places in the fixing section 80 (for example, the second fixing temperature sensor and the fourth fixing temperature sensor) where the fixing temperature is closest to the desired temperature, the formation area of the toner patch image TP formed in the image forming section 40 is changed in the axial direction of the fixing section 80 so that the patch rows of the toner patch image TP are separately located in the second fixing temperature sensor and the fourth fixing temperature sensor. In such a case, as shown in FIG. 14 for example, the formation area of the toner patch image TP is changed so that the patch row of cyan (C) is located in the place of the second fixing temperature sensor, and the patch row of black (K) is located in the place of the fourth fixing temperature sensor.

EXAMPLE 3

In Examples 1 and 2, the conveying position of the sheet S (or the formation area of the toner patch image TP) in the axial direction of the fixing section 80 and the detection area of the detector 230 are set based on the temperature detection values of the fixing temperature sensors 221 to 225 of the fixing temperature detector 220.

Figure 15:
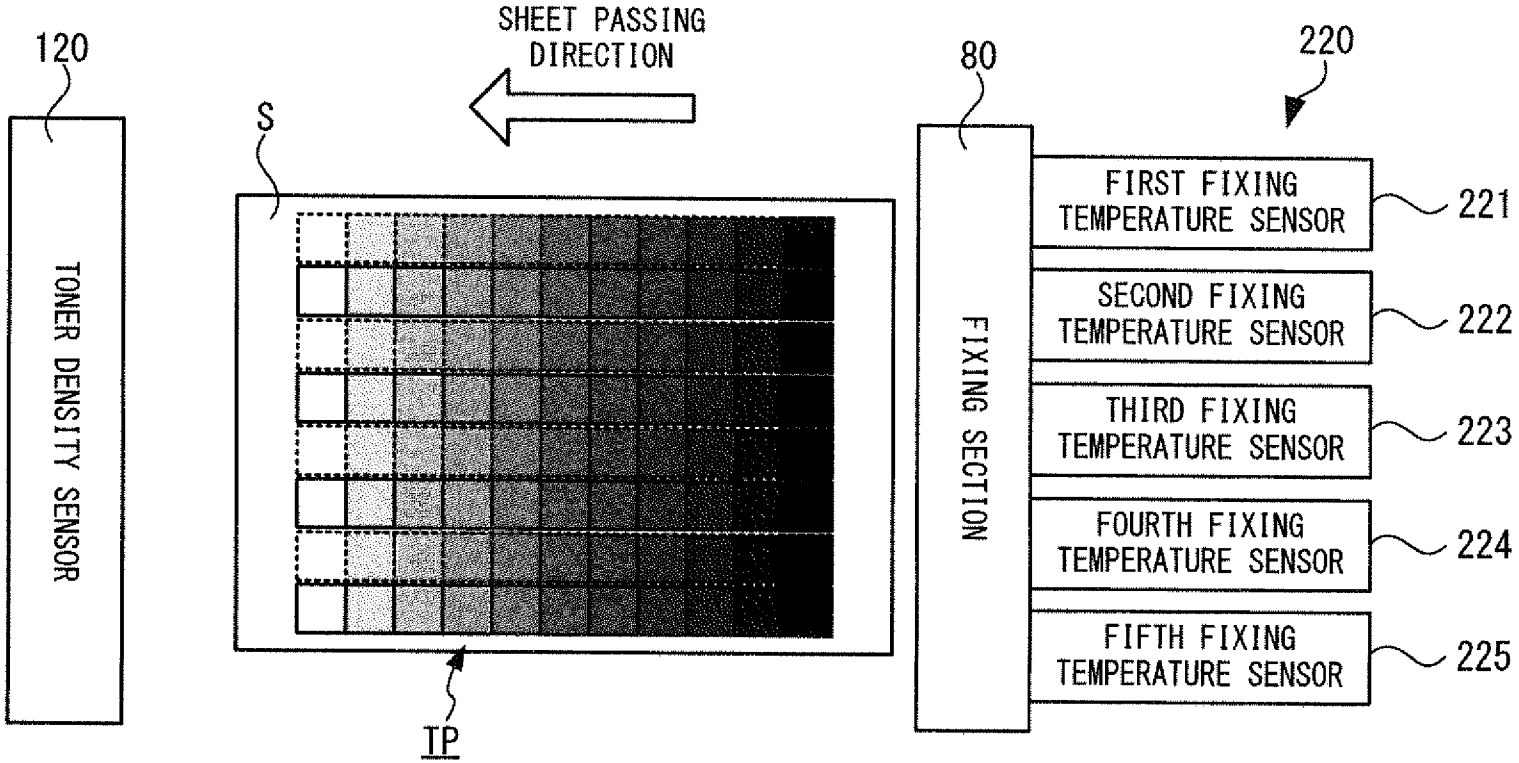
FIG. 15 is a view for explaining Example 3.

In contrast, in Example 3, as shown in FIG. 15, a configuration is adopted in which the toner patch image TP (i.e., the image-adjusting pattern image) is formed over the whole sheet S, while only the detection area of the detector 230 (which includes the toner density sensor 120) is set at a place (area) where the fixing temperature is closest to the desired temperature. By adopting such configuration, although the consumption of toner increases, it is unnecessary to change the conveying position of the sheet S in the axial direction of the fixing section 80, or change the formation area of the toner patch image TP even if temperature unevenness is caused in the axial direction of the fixing section 80.

Figure 16:
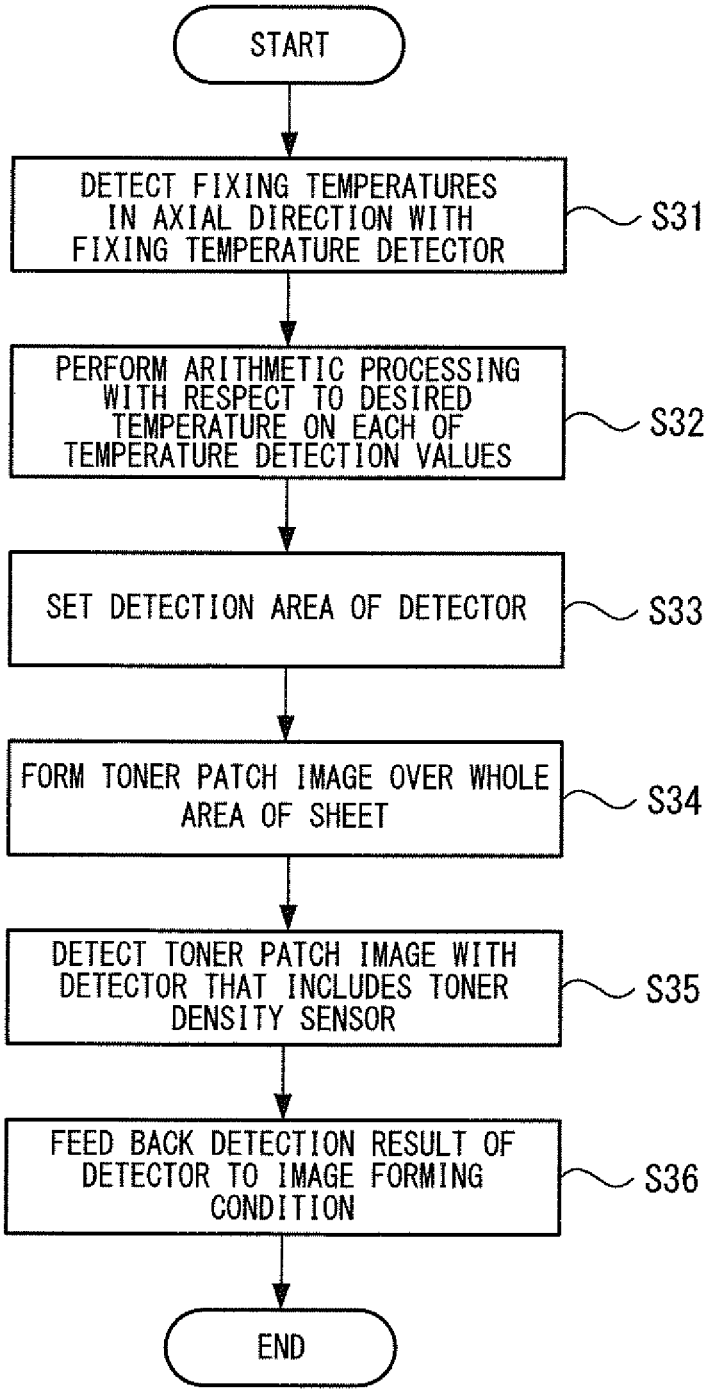
FIG. 16 is a flowchart showing the flow of concrete processing of Example 3.

The flow of the concrete processing of Example 3 will be described below with reference to the flowchart of FIG. 16. Such processing is performed under the control of the controller 210.

When performing the control of determining the image forming condition based on the detection result of the detector 230 (which includes the toner density sensor 120), first, the fixing temperature detector 220 detects the fixing temperatures of the plurality of points in the axial direction of the fixing section 80 (step S31).

Next, the arithmetic processing for calculating difference between the temperature detection value and the desired temperature is performed on the temperature detection value of each of the five fixing temperature sensors 221 to 225 of the fixing temperature detector 220 (step S32). Next, based on the distribution of the temperature detection values of the fixing temperature sensors 221 to 225 in the axial direction of the fixing section 80, a place where the fixing temperature is closest to the desired temperature is identified, and the detection area of the detector 230 is set at the identified place (step S33).

Next, in the image forming section 40, a toner patch image TP is formed over the whole sheet S (step S34). The sheet S on which the toner patch image TP has been formed is outputted from the image forming section 40. In the fixing section 80, the toner image is fixed onto the sheet S by being pressed and heated.

Next, information about the color, density and the like of the toner patch image TP fixed onto the sheet S is detected by the detector 230 (which includes the toner density sensor 120) arranged on the downstream side of the fixing section 80 (step S35). Next, the detection result of the detector 230 is fed back to the image forming condition of the image forming section 40, and thereby the image forming condition is determined (step S37).

Although the aforesaid embodiment is described based on an example in which the present invention is applied to a copying machine (as the image forming apparatus 1), the present invention is not limited to this example. To be specific, the present invention may be applied to any kind of electrophotographic image forming apparatus that forms an image using static electricity, such as a printer, a facsimile machine, a printing machine, a composite machine or the like. Further, the present invention may also be applied to a so-called production printing machine which has a separately-arranged sheet feeding unit, and which can form image at high speed.

What is claimed is:

1. An image forming apparatus that uses an image-adjusting pattern image to determine an image forming condition, the apparatus comprising:

a detector adapted to detect information about an image-adjusting pattern image fixed onto a sheet;

a fixing temperature detector having a plurality of sensors adapted to detect temperatures of a plurality of points in the axial direction of a fixing roller of a fixing section, wherein the fixing section is adapted to fix the image-adjusting pattern image onto the sheet; and a controller adapted to set, based on temperature detection values detected by the fixing temperature detector, a detection area in a place of the detector where the temperature is equal to a desired temperature, wherein the detection area is an area where the detector detects information about the image-adjusting pattern image, and use the information detected in the detection area by the detector to determine the image forming condition.

2. The image forming apparatus according to claim 1, wherein the detector has a sensor whose pixels are linearly arranged over the entire area in a direction perpendicular to a conveying direction of the sheet.

3. The image forming apparatus according to claim 2, wherein, based the temperature detection values detected by the fixing temperature detector, the controller performs a control so that the position of the image-adjusting pattern image to be formed onto the sheet is changed in the axial direction of the fixing roller.

4. The image forming apparatus according to claim 2, wherein, based the temperature detection values detected by the fixing temperature detector, the controller performs a control so that the position from which the sheet is to be conveyed to the fixing section is changed in the axial direction of the fixing roller.

5. The image forming apparatus according to claim 2, wherein the image-adjusting pattern image is formed over the entire area of the sheet.

6. The image forming apparatus according to claim 1, wherein, based the temperature detection values detected by the fixing temperature detector, the controller performs a control so that the position of the image-adjusting pattern image to be formed onto the sheet is changed in the axial direction of the fixing roller.

7. The image forming apparatus according to claim 1, wherein, based the temperature detection values detected by the fixing temperature detector, the controller performs a control so that the position from which the sheet is to be conveyed to the fixing section is changed in the axial direction of the fixing roller.

8. The image forming apparatus according to claim 1, wherein the image-adjusting pattern image is formed over the entire area of the sheet.

9. An image forming method that uses an image-adjusting pattern image to determine an image forming condition, the method comprising the steps of:

detecting, by a fixing temperature detector having a plurality of sensors, temperatures of a plurality of points in the axial direction of a fixing roller of a fixing section, wherein the fixing section is adapted to fix the image-adjusting pattern image onto a sheet; and setting, based on temperature detection values detected by the fixing temperature detector, a detection area in a place of a detector where the temperature is equal to a desired temperature, wherein the detection area is an area where the detector detects information about the image-adjusting pattern image, and using the information detected in the detection area by the detector to determine the image forming condition.

10. The image forming method according to claim 9, wherein the detector detects information about a linear area across the entire area in a direction perpendicular to a conveying direction of the sheet.

11. The image forming method according to claim 10, further comprising the step of:

performing, based the temperature detection values detected by the fixing temperature detector, a control so that the position of the image-adjusting pattern image to be formed onto the sheet is changed in the axial direction of the fixing roller.

12. The image forming method according to claim 10, further comprising the step of:

performing, based the temperature detection values detected by the fixing temperature detector, a control so that the position from which the sheet is to be conveyed to the fixing section is changed in the axial direction of the fixing roller.

13. The image forming method according to claim 9, further comprising the step of:

performing, based the temperature detection values detected by the fixing temperature detector, a control so that the position of the image-adjusting pattern image to be formed onto the sheet is changed in the axial direction of the fixing roller.

14. The image forming method according to claim 9, further comprising the step of:

performing, based the temperature detection values detected by the fixing temperature detector, a control so that the position from which the sheet is to be conveyed to the fixing section is changed in the axial direction of the fixing roller.

15. The image forming method according to claim 9, wherein the image-adjusting pattern image is formed over the entire area of the sheet.

* * * * *